United States Patent [19]

Guerton et al.

[11] 4,209,967

[45] Jul. 1, 1980

[54] RESILIENT COUPLING DEVICE FOR TEXTILE TWISTING APPARATUS

[75] Inventors: Jean P. Guerton, Maisons Alfort; Jean Waleckx, Villebon sur Yvette; Jean M. Monville, Paris, all of France

[73] Assignee: SKF Compagnie d'Applications Mechaniques, Clamart, France

[21] Appl. No.: 26,630

[22] Filed: Apr. 2, 1979

Related U.S. Application Data

[63] Continuation-in-part of Ser. No. 882,513, Mar. 1, 1978, Pat. No. 4,158,282.

[30] Foreign Application Priority Data

Apr. 18, 1978 [FR] France ..... 78 11424

[51] Int. Cl.[2] ..... D01H 7/86

[52] U.S. Cl. ..... 57/58.72; 57/58.74

[58] Field of Search ..... 57/58.72–58.81, 57/58.49, 58.83

[56] References Cited

U.S. PATENT DOCUMENTS

| | | | |
|---|---|---|---|
| 2,521,601 | 9/1950 | Planet | 57/58.72 |
| 2,795,102 | 6/1957 | Brown | 57/58.72 |
| 2,873,570 | 2/1959 | Sage | 57/58.72 |
| 3,044,246 | 7/1962 | Schippers | 57/58.72 X |
| 3,296,787 | 1/1967 | Maurin | 57/58.81 |

*Primary Examiner*—John Petrakes

*Attorney, Agent, or Firm*—Beveridge, DeGrandi, Kline & Lunsford

[57] ABSTRACT

Two non-concentric rotating assemblies of a double-twist textile twister are connected together for concurrent rotation. Each assembly has fastening members which are connected to fastening members on the other assembly by a substantially unstretchable traction element and a compressively deformable resilient element which is located between the traction element and the respective fastening member.

10 Claims, 9 Drawing Figures

FIG. 1
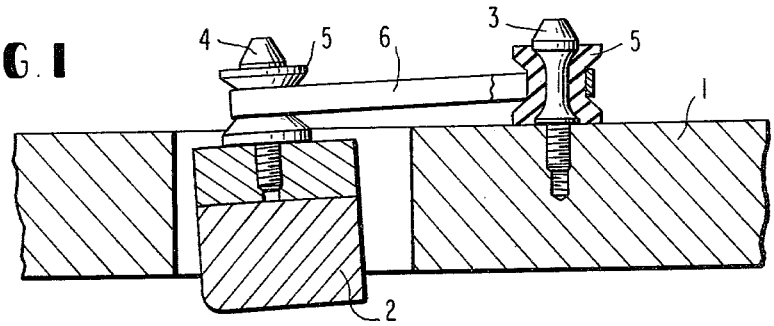
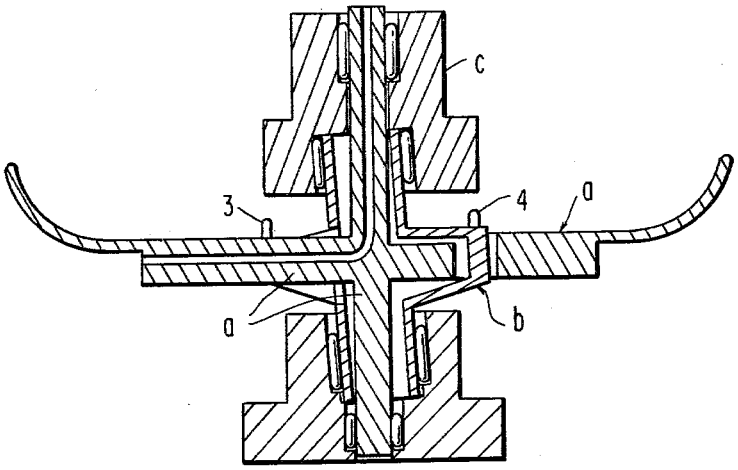
FIG. 1a
FIG. 2
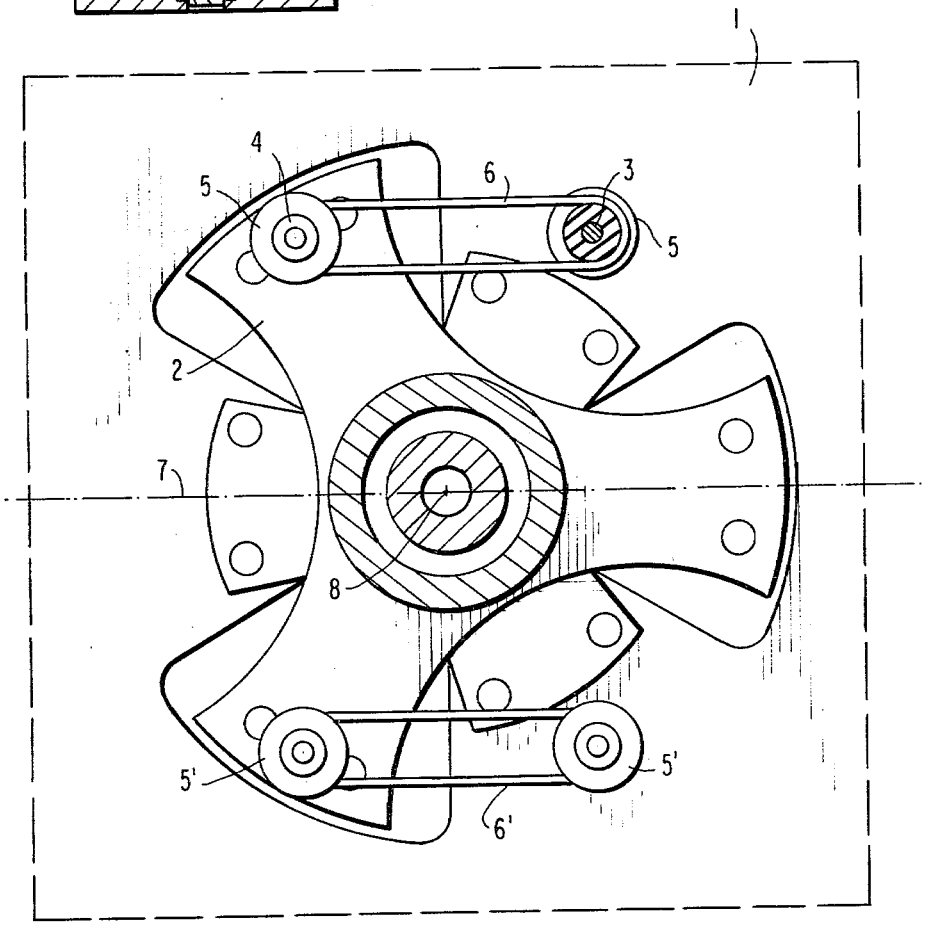

RESILIENT COUPLING DEVICE FOR TEXTILE TWISTING APPARATUS

REFERENCE TO RELATED APPLICATION

This is a continuation-in-part of U.S. patent application Ser. No. 882,513, filed Mar. 1, 1978, now U.S. Pat. No. 4,158,282, and entitled Twister Mechanism with Elastic Part.

BACKGROUND OF THE INVENTION

This invention relates to a resilient coupling device for a double-twist twisting mechanism with two assemblies which rotate about adjacent non-concentric axes. A twisting mechanism of this type described in copending U.S. patent application Ser. No. 882,513, filed Mar. 1, 1978, the entirety of which is incorporated herein by reference.

Mechanisms of this type comprise a centered assembly which includes a rotational spindle and a spool holder, and an off-centered assembly which rotates about an axis which is oblique to the rotational axis of the centered assembly and is pivotally connected to the spool holder and to a stationary base or frame. These two assemblies are fitted one into the other, and they are coupled together by resilient means.

The resilient coupling means disclosed in the prior application is a polygonal ring of flexible elastomeric material, having pin-receiving openings at each corner. These openings fit over a certain number of pins. All of the pins project in the same direction, substantially at the same level and are fixed alternately in the centered assembly and in the off-centered assembly so as to enable this ring to be easily placed in position and removed. For this purpose, the distance between the axes of the various pins must be such that the perimeter of the polygonal ring is sufficient to enable the ring to pass around the members of the twisting mechanism. Each side of the polygonal ring forms an elastomeric tie bar, which is able to work only under tension so that during rotation it undergoes an overall elongation due to the centrifugal force acting on its mass. Also, alternating elongations lead to breakage of the ring, particularly in the area where it is connected to the pins.

It is an object of the present invention to overcome the aforesaid drawbacks by providing an improved resilient coupling means for a twisting mechanism of the above-mentioned type. The improved coupling means is less susceptible to breakage, has less mass affected by centrifugal force, and imposes no geometrical requirement on the spacing of the pins relative to the axis of the twister.

SUMMARY OF THE INVENTION

According to the present invention, the assemblies which rotate about adjacent non-concentric axes are provided with fastening means which are connected together so rotation of one assembly will produce rotation of the other assembly. The fastening means of one assembly is connected to a fastening means on the other assembly by a connecting means which includes a substantially unstretchable flexible traction element and a deformable resilient element located between the traction element and one of the fastening means.

According to some embodiments of the invention, the fastening means are axially oriented pins and the deformable elements are generally cylindrical bearings mounted on the pins. The traction element may be a closed loop of material, a cable having eyes at its opposite ends for engaging the bearings, or a cable detachably connected to a lug which is engaged with the bearing.

In another embodiment, the fastening means is a member with a blind bore which is slotted to enable a cable to be inserted laterally to a central position. The bearing is located in the bore, and the cable has a head engaged with the bearing to compress the bearing against the blind end of the bore.

BRIEF DESCRIPTION OF THE DRAWINGS

The invention will be further described, by way of example only, with reference to the accompanying drawings, in which:

FIG. 1*a* is a diagrammatic view of a double-twist twister, without the coupling between the two rotating assemblies;

FIGS. 1 and 2 are vertical and horizontal partial sections respectively through a first embodiment of a coupling device according to the invention;

DESCRIPTION OF THE PREFERRED EMBODIMENT

Figure 3:
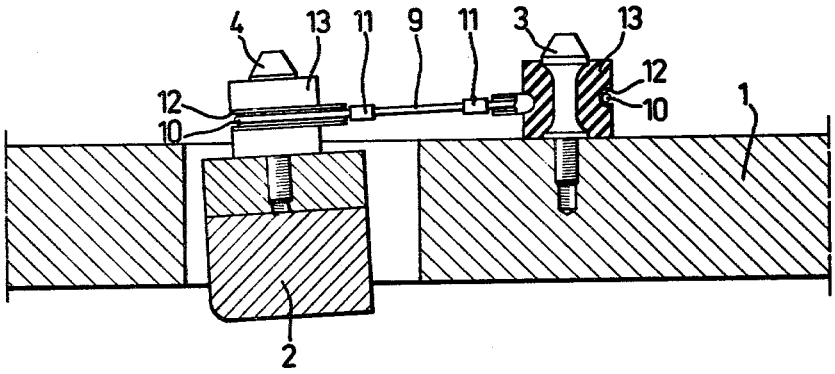
FIGS. 3 and 4 are views corresponding to FIGS. 1 and 2, of a second embodiment of a coupling device according to the invention.

FIG. 1*a* shows somewhat diagramatically a double twist twister which has a centered assembly a rotatable about its longitudinal axis, an off-centered assembly b rotatable about its longitudinal axis, and a nonrotatable spool carrier c which is supported by bearings on the upper ends of assemblies a and b. The rotational axes of assemblies a and b are adjacent to each other and are non-concentric. Portions of the disc of assembly a extend in a circumferential direction through openings in the assembly b; and, portions of the off-centered assembly b extend axially through openings in the disc portion of the assembly a.

Rotational movement is imparted to one of the assemblies a or b by an external source, and this rotation is transmitted to the other assembly by tangentially extending flexible members which are fastened to the assemblies and a and b, as more specifically described in connection with FIGS. 1–8. Rovings, strands, yarns or like textile materials move downwardly and radially outwardly through bores in the centered assembly a, whereupon it moves upwardly to form a balloon which is wound on a spool on the spool carrier c. The general construction and operation of such apparatus described in greater detail in U.S. patent application Ser. No. 882,513, filed Mar. 1, 1978, which is incorporated herein by reference.

FIGS. 1 and 2 show a plate 1 of a centered assembly, and a part 2 of an off-centered assembly which fits into the former. Pins 3 and 4 can also be seen, these being identical but the pins 3 are disposed in the centered assembly and the pins 4 in the off-centered assembly.

Resilient bearings 5 of an elastomeric material are mounted on at least one of the pins 3 or 4, being mountable thereon by simple elastic deformation. A traction element 6 is fitted over the bearings 5. Each of the traction elements 6 is a simple flexible closed loop or band of textile, metal or other material which is flexible and substantially unstretchable. As the pins 3 and 4 tend to move away from each other, tension in the traction element 6 exerts a force which radially compresses and deforms the resilient bearings 5. Any elongation of the traction element is almost negligible in comparison with the compression of the bearings. With this arrangement, there is no risk of the traction element 6 breaking due to alternate elongation stresses. The low mass of the traction element 6 deters any substantial deformation due to centrifugal force. The resilient bearings 5 undergo alternating stresses, but these are only compression stresses which do not lead to rupture.

Considering now the action of the centered assembly 1 on the off-centered assembly 2, this action consists of a force applied to the pin 4 in the direction of the pin 3, the result of which is a clockwise force on assembly 4 as seen in FIG. 2. The connecting or coupling means, including the elements 5 and 6, are symmetrically disposed, for example, about the straight line 7 of FIG. 2, so that a similar but oppositely acting connecting or coupling means formed by bearings 5' and traction element 6' biases the assembly 2 in a counterclockwise direction relative to assembly 1. This causes the assembly to remain in equilibrium, both when at rest and in operation. The number of pairs of opposing coupling means may be multiplied so that they extend entirely around the axis 8, each pin 3 or 4 possibly being common to two traction elements 6 at a time.

If it is necessary to replace the connection members, this becomes extremely simple in that only the broken or defective member 5 or 6 is replaced, without replacing the intact members. Replacement is effected by preliminarily positioning the two resilient bearings 5 in the flexible band 6, and then placing the two resilient bearings 5 either simultaneously or successively over pins 3 and 4 by applying simple axial pressure. It can be seen that no minimum distance is required between the pins 3 or 4 and the axis 8 of the device for assembly and removal purposes; however, as this distance is reduced, the forces imposed on the coupling during operation of the apparatus will naturally increase.

The traction element 6 may, alternatively, be a flexible, unstretchable textile reinforcement interiorly coated with a thick, compressively deformable elastomer. Such a traction element may pass directly around the two pins 3 and 4 at the same time, to form a single connecting member which includes both the traction element and the resilient element.

Figure 4:
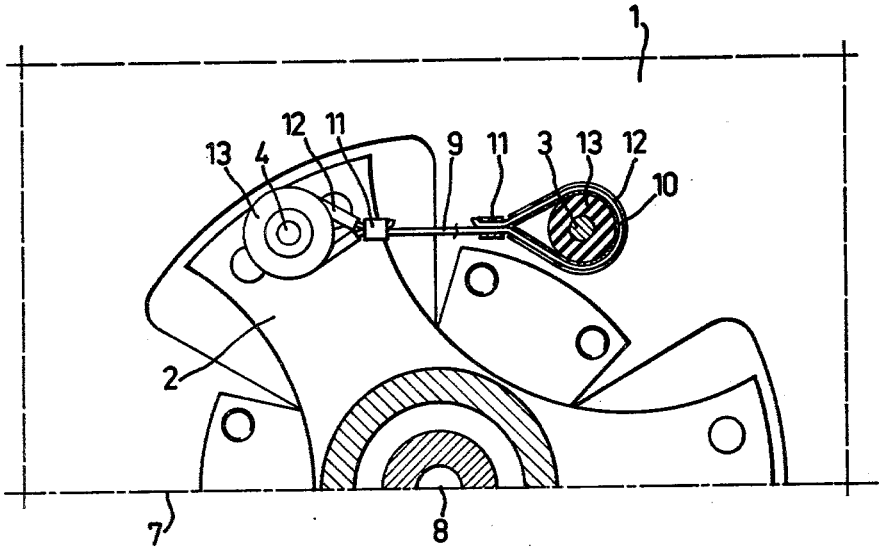

The device shown in FIGS. 3 and 4 is similar to that shown in FIGS. 1 and 2 except that the traction element 6 is replaced by an unstretchable flexible cable 9 of steel or other material, each end of which comprises an eye 10 closed by a crimped sleeve 11 and surrounded by a protective sheath 12 of the type used in marine situations, this latter piece being optional. The eyes engage elastomer bearings 13 on pins 3 and 4, these bearings 13 being similar to the bearings 5 but having a narrower groove suitable for holding the cores 12 or the cable directly. The method of mounting, operation and possible replacement are exactly the same as described in connection with FIGS. 1 and 2.

Figure 5:
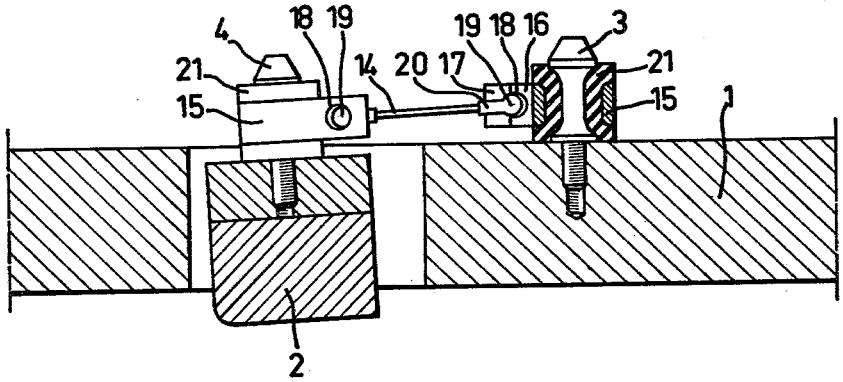
FIGS. 5 and 6 are corresponding views of a third embodiment of a coupling device according to the invention; and, FIGS. 7 and 8 are corresponding views of a fourth embodiment of a coupling device acccording to the inveniton.
Figure 6:
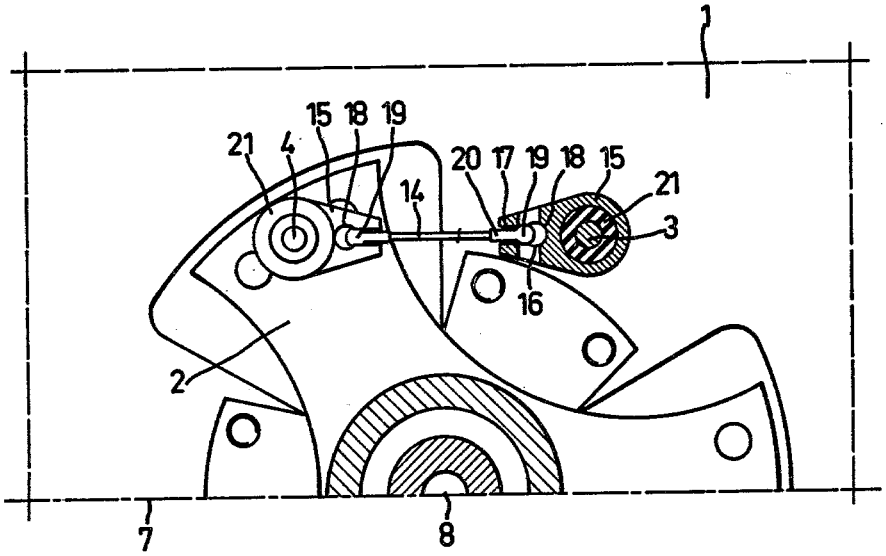

In the embodiment shown in FIGS. 5 and 6, there is a flexible unstretchable cable 14, similar to cable 9, but provided at each of its ends with a spherical head 19 of a ferrule 20 crimped or molded onto the end of the cable 14 by a method similar to that used for bicycle control cables. Fixing lugs 15 are connected to the opposite ends of the cable 14. Each fixing lug 15 has a substantially oval contour as shown in FIG. 6, a bore 16 parallel to the axis of the corresponding pin 3 or 4, and a slot 17 parallel to the axis of the bore 16. A further bore 18 is perpendicular to the bore 16 and offset therefrom so the edge of the bore 18 in the direction of the exit of the slot 17 is closer to this exit than the lines of intersection of the bore 16 and the slot 17. Bearings 21 have a shape which enables them to be fit inside the lugs 15. The method of mounting, operating and replacing the connector is essentially the same as in the previous embodiments.

Figure 7:
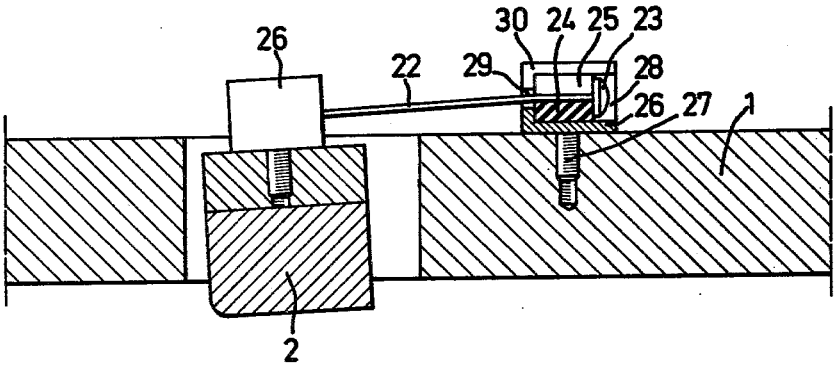
Figure 8:
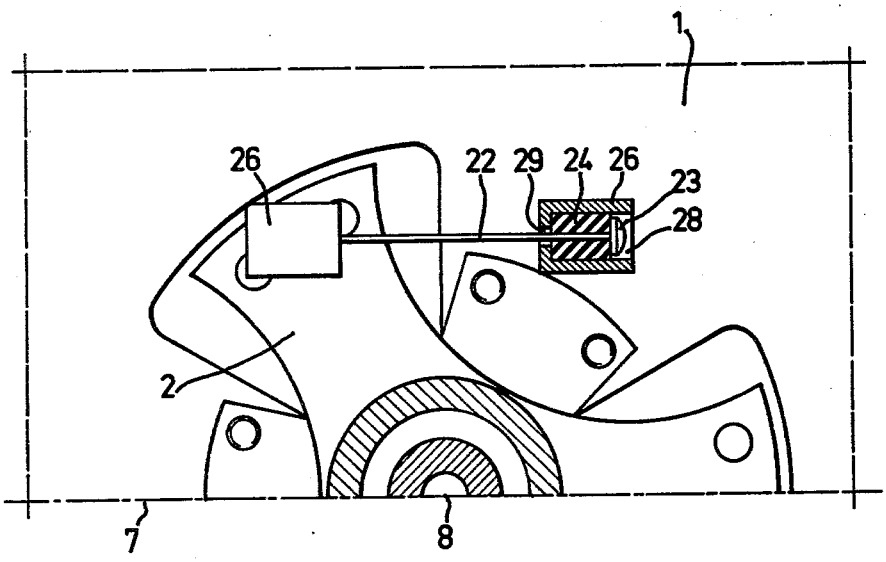

Finally, in the embodiment shown in FIGS. 7 and 8, the traction element is an unstretchable cable 22 terminating in crimped or molded heads 23. The resilient bearings 24 in this case have horizontal axes, and a slot 25 opening upward. Each of these bearings is enclosed in a connection piece 26 which has a threaded anchor rod 27 and an internal blind bore 28 for housing the bearing 24. The piece 26 has a bore 29 in the blind end, and a slot 30 which extends to bore 29 through the side wall and blind end of the piece 26. The blind bore 28 is slightly deeper than the length of the bearing 24 so the head 23 will fit within the piece 26.

Contrary to the previous embodiments, in this embodiment the resilient bearings 24 are compressed along their axial direction rather than their radial direction. In this instance, their compressibility can be improved by providing them with holes or grooves. During installation, the bearings 24 are placed in the connection pieces 26 before putting the cable 22 in place. The cable is then fitted first into one connection piece then into the other by passing it through the slots 30 and 25 by pulling on the cable 22, or exerting a relative couple between the centered assembly and off-centered assembly.

Again, the traction elements 22 operate only under tension without any noticeable elongation, and the elasticity is provided exclusively by the axial compression of the bearings 24. There is no risk of breaking the elements 22 or 24, and there is no geometrical requirement on the distance between the axis of the connection pieces 26 and the axis 8 of the device. Further, the cable 22 is easily replaced.

In all the above embodiments, it is preferably to use traction element-compression bearing assemblies which are prestressed when the twister is in a non-rotating rest condition, in order to improve the starting couple.

Persons skilled in the art will realize that the invention will take many forms other than the disclosed preferred embodiments. Accordingly, it is emphasized that the invention is not limited to the disclosed embodiments, but embraces a wide variety of coupling devices which fall within the spirit of the following claims.

We claim:

1. A resilient coupling device for a double-twist twisting mechanism, comprising, a centered assembly rotatable about a first axis and an off-centered assembly which rotates about a second axis which is adjacent to but not concentric with the first axis, each of said assemblies having at least two fastening means spaced from their respective axes, and a pair of oppositely-acting connecting means which each connect a fastening means on one assembly with a fastening means on the other assembly whereby rotation of one assembly will produce rotation of the other assembly, each connecting means including a substantially unstretchable flexible traction element and a compressibly deformable resilient element located between the traction element and a said fastening means.

2. The coupling device of claim 1, wherein the fastening means is a pin and each of the resilient elements is a bearing which is mounted on said pin, each of said bearings having a groove receiving the pin, said pin being oriented substantially perpendicular to the traction element.

3. The coupling device of claim 2, wherein each of the traction elements is a closed loop.

4. The coupling device of claim 2, wherein each of the traction elements is a flexible cable.

5. The coupling device of claim 4, wherein the ends of the cable each comprise an eye closed by a crimped sleeve.

6. The coupling device of claim 5, wherein the eye is surrounded by a sheath.

7. The coupling device of claim 4, having a head at each end of the cable, a lug having a slotted aperture receiving said head, said lug being fitted onto a said bearing.

8. The coupling device of claim 7, wherein the slotted aperture includes a first bore parallel to the pin, a slot parallel to the cable and intersecting said first bore, a second bore perpendicular to said slot and offset to provide an edge which is closer to the slot exit than the intersection of the said first-mentioned bore with the said slot.

9. A coupling device as claimed in claim 1, wherein each of the traction elements is a cable having a head at each end thereof, each of the resilient elements being disposed with its axis positioned along the direction of the cable, each of said fixing elements including a blind bore, said head being disposed inside said blind bore, and radial slots in the respective bearing as far as the level of the cable to enable the cable to be inserted laterally therein, the said blind bore being slightly deeper than the axial length of the bearing to allow the head to be received in the bore.

10. A coupling device as claimed in claim 1 wherein the deformable element is compressed when the device is at rest.

* * * * *